US006931792B2

(12) United States Patent
McDonald et al.

(10) Patent No.: US 6,931,792 B2
(45) Date of Patent: Aug. 23, 2005

(54) UNIVERSAL END CAP AND METHOD FOR RAIN GUTTER DEBRIS GUARDS

(75) Inventors: Thomas A. McDonald, Grand Rapids, MI (US); Tony A. Cobb, Wyoming, MI (US)

(73) Assignee: Quality Edge, Inc., Walker, MI (US)

( * ) Notice: Subject to any disclaimer, the term of this patent is extended or adjusted under 35 U.S.C. 154(b) by 0 days.

(21) Appl. No.: 10/719,865

(22) Filed: Nov. 21, 2003

(65) Prior Publication Data

US 2005/0108951 A1 May 26, 2005

(51) Int. Cl.[7] ..... E04D 13/00
(52) U.S. Cl. ..... 52/12; 52/11; 52/15
(58) Field of Search ..... 52/11, 12, 14, 15; 248/48.1, 48.2, 221.4; 24/295

(56) References Cited

U.S. PATENT DOCUMENTS

| | | | | |
|---|---|---|---|---|
| 4,190,988 | A * | 3/1980 | Carreiro | 52/16 |
| 4,455,791 | A | 6/1984 | Elko et al. | |
| 4,998,386 | A * | 3/1991 | Baumgarth | 52/16 |
| 5,305,562 | A | 4/1994 | Sapia | |
| 5,437,138 | A * | 8/1995 | Tuohey et al. | 52/741.1 |
| 5,557,891 | A | 9/1996 | Albracht | |
| 6,314,685 | B1 | 11/2001 | Sullivan | |
| 6,681,527 | B2 * | 1/2004 | Baker | 52/12 |
| 2002/0073631 | A1 | 6/2002 | Baker | |
| 2003/0070366 | A1 | 4/2003 | Beyers | |

* cited by examiner

*Primary Examiner*—Carl D. Friedman
*Assistant Examiner*—Chi Q. Nguyen
(74) *Attorney, Agent, or Firm*—Price, Heneveld, Cooper, DeWitt & Litton, LLP

(57) ABSTRACT

A universal end cap and associated method are provided for rain gutter debris guards of the type having a top cap extending along a roof and over the open top of an associated gutter. The universal end cap includes a generally flat, rigid cover panel with a substantially rectangular lower portion sized to extend over either end of the guard, and is severable to custom fit the end cap to a wide variety of different gutters. A pair of curved nose portions project outwardly from opposite sides of the cover panel adjacent the upper edge thereof, and are configured to close off the forward portion of the top cap at either end thereof. A mounting flange extends along at least a portion of the upper edge of the cover panel, and a retainer fastens the mounting flange to the top cap at either end thereof to prevent debris form entering between the adjacent ends of the gutter and the guard.

28 Claims, 8 Drawing Sheets

UNIVERSAL END CAP AND METHOD FOR RAIN GUTTER DEBRIS GUARDS

CROSS-REFERENCE TO RELATED APPLICATIONS

The present application is related to commonly assigned, copending U.S. patent application Ser. No. 10/458,562, filed Jun. 10, 2003, entitled RAIN GUTTER GUARD AND METHOD, which is hereby incorporated herein by reference.

BACKGROUND OF THE INVENTION

The present invention relates to rain gutter debris guards, and in particular to a universal end cap and method therefor.

Gutter protection systems, such as guards, caps, screens and shields, are well known in the art, and are designed to prevent leaves and other debris from entering the trough-shaped interior of the gutter, while directing runoff water to a desired location. Some types of gutter guards, such as those disclosed in U.S. Pat. Nos. 6,182,399 and 5,845,435, are incorporated into a complete gutter system of the type having a special gutter shape. Consequently, such guards cannot be used to retrofit an existing conventional gutter.

Some types of gutter guards, such as that disclosed in U.S. Patent Publication 2002/0073631 A1, attach to the existing hangers of a conventional gutter, while others, such as that disclosed in U.S. Patent Publication No. 2002/0069594 A1, employ special clips to attach the guard to the front lip of an existing gutter. In both such designs, extra stress is applied to the gutter and/or associated hangers as a result of the weight of the guard, as well as the runoff water and related debris. This additional weight can result in substantial problems, particularly when the existing gutter is installed without anticipating the additional weight of a retrofitted guard.

Many types of gutter guards are currently available, including those that use screens or expanded metal panels, as well as those using imperforate caps or top sheets. Typically, both of these designs rely upon the rain gutter itself for support, and/or must be fastened to the roof, resulting in increased installation difficulty, costs and potential leakage. Those gutter guards which employ imperforate caps or top sheets, such as the devices disclosed in U.S. Patent Publication U.S. 2002/0073631 A1, as well as Applicant's own related U.S. pending patent application Ser. No. 10/458,562, entitled RAIN GUTTER GUARD AND METHOD, have open ends between the top of the gutter and the cap or top sheet. These open ends are preferably closed off to prevent debris from entering between the adjacent ends of the gutter and the guard. While end panels have been formed integrally with the top cap, or fixedly mounted to the same, such constructions require separate left and right hand parts, are relatively expensive, and are not adapted to accommodate use with a wide variety of differently shaped and sized gutters.

SUMMARY OF THE INVENTION

One aspect of the present invention is a rain gutter debris guard having an inclined top cap with a rearward portion extending along an associated roof, a medial portion extending over an interior portion of an associated gutter, and a curved forward portion extending adjacent to a front lip portion of the gutter, in combination with a universal end cap therefor. The universal end cap comprises a generally flat, rigid cover panel having an upper edge, a lower edge, and opposite side edges, and includes a substantially rectangular lower portion sized to extend over either one of the opposite ends of the rain gutter debris guard and the gutter, and is severable to custom fit the universal end cap to a wide variety of different gutters. A pair of curved nose portions project outwardly from the opposite side edges of the cover panel adjacent the upper edge thereof, and are configured to close off the curved forward portion of the top cap at either one of the opposite ends thereof. The universal end cap also includes a mounting flange extending along at least a portion of the upper edge of the cover panel, and extending laterally inwardly in a generally perpendicular relationship with the cover panel for attachment to the top cap at either end of the gutter. A retainer fastens the mounting flange to the top cap at either one of the opposite ends thereof, such that the universal end cap encloses one of the opposite ends of the rain gutter debris guard to prevent debris from entering between the adjacent ends of the gutter and the rain gutter debris guard.

Another aspect of the present invention is a rain gutter debris guard, comprising an inclined top cap with a rearward portion extending along an associated roof, a medial portion extending over an interior portion of an associated gutter, and a curved forward portion extending adjacent to a front lip portion of the gutter. The rain gutter debris guard also includes a universal end cap, having a generally flat, rigid cover panel with an upper edge, a lower edge, and opposite sides, and including a substantially rectangular lower portion sized to extend over either one of the opposite ends of the rain gutter debris guard and the gutter, and being severable to custom fit the end cap to a wide variety of different gutters. A pair of curved nose portions project outwardly from the opposite side edges of the cover panel adjacent the upper edge thereof, and are configured to close off the curved forward portion of the top cap at either one of the opposite ends thereof. A mounting flange extends along at least a portion of the upper edge of the cover panel, and extends laterally inwardly in a generally perpendicular relationship with the cover panel for attachment to the top cap at either end of the gutter. A retainer fastens the mounting flange to the top cap at either one of the opposite ends thereof, such that the end caps enclose one of the opposite ends of the rain gutter debris guard to prevent debris from entering between the adjacent ends of the gutter and the rain gutter debris guard.

Yet another aspect of the present invention is a universal end cap for rain gutter debris guards of the type having an inclined top cap with a rearward portion extending along an associated roof, a medial portion extending over an interior portion of an associated gutter, and curved forward portion extending adjacent to a front lip portion of the gutter. The universal end cap comprises a generally flat, rigid cover panel having an upper edge, a lower edge, and opposite side edges, and includes a substantially rectangular lower portion sized to extend over either one of the opposite ends of the rain gutter debris guard and the gutter, and is severable to custom fit the end cap to a wide variety of different gutters. A pair of curved nose portions project outwardly from the opposite side edges of the cover panel adjacent the upper edge thereof, and are configured to close off the curved forward portion of the top cap at either one of the opposite ends thereof. A mounting flange extends along at least a portion of the upper edge of the cover panel, and extends laterally inwardly in a generally perpendicular relationship with the cover panel for attachment to the top cap at either end of the gutter. A retainer fastens the mounting flange to the top cap at either one of the opposite ends thereof, such that the end cap closes one of the opposite ends of the rain gutter debris guard to prevent debris from entering between the adjacent ends of the gutter and the rain gutter debris guard.

Yet another aspect of the present invention is a method for deflecting debris and the like from rain gutters of the type having a generally trough-shaped interior and a front lip. The method includes providing a top cap having a rearward portion thereof shaped to extend along an associated roof, a medial portion shaped to extend over the interior of the gutter, and a forward portion shaped to extend adjacent to the front lip of the gutter. At least one mounting bracket is provided, each of which has a rearward portion shaped to abut a rear wall of the gutter, and an upper portion shaped to support the top cap to deflect debris from the interior of the gutter. The rearward portion of the mounting bracket is attached to the rear wall of the gutter and associated roof fascia. The top cap is then attached to the upper portion of the mounting bracket, such that the top cap overlies the interior of the gutter to deflect debris therefrom. At least one universal end cap is provided having a generally flat, rigid cover panel with an upper edge, a lower edge, and opposite side edges, as well as a substantially rectangular lower portion sized to extend over either one of the opposite ends of the rain gutter, and is severable to custom fit the end cap to a wide variety of different gutters. The universal end cap also includes a pair of curved nose portions projecting outwardly from the opposite side edges of the cover panel adjacent the upper edge thereof to close off the curved forward portion of the top cap at either one of the opposite ends, as well as a mounting flange extending along at least a portion of the upper edge of the cover panel, and extending laterally inwardly in a generally perpendicular relationship with the cover panel for attachment to the top cap at either end of the gutter. The mounting flange of the universal end cap is fastened to the top cap at either one of the opposite ends thereof, such that the universal end cap encloses the space between the adjacent ends of the gutter and the top cap to prevent debris from entering therebetween.

The present invention has an uncomplicated design, and can be used not only at either end of the associated rain gutter debris guard, but can also be custom fit to a wide variety of differently shaped and sized gutters. The universal end cap can be quickly and easily installed, is very durable, efficient in use, economical to manufacture, capable of a long operating life, and particularly well adapted for the proposed use.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
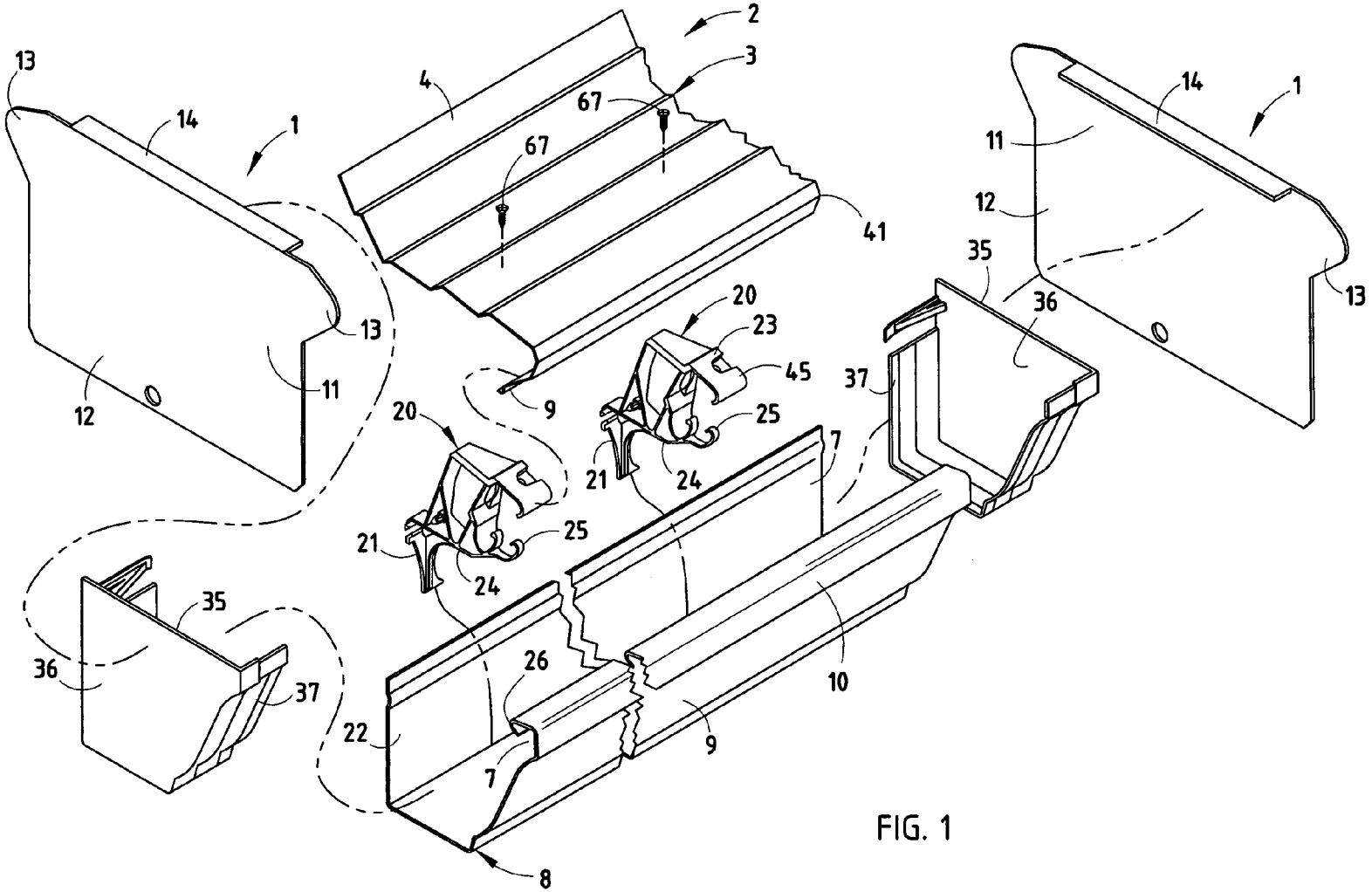
FIG. 1 is a perspective view of a pair of universal end caps embodying the present invention, shown exploded away from an associated rain gutter and rain gutter debris guard.
Figure 5:
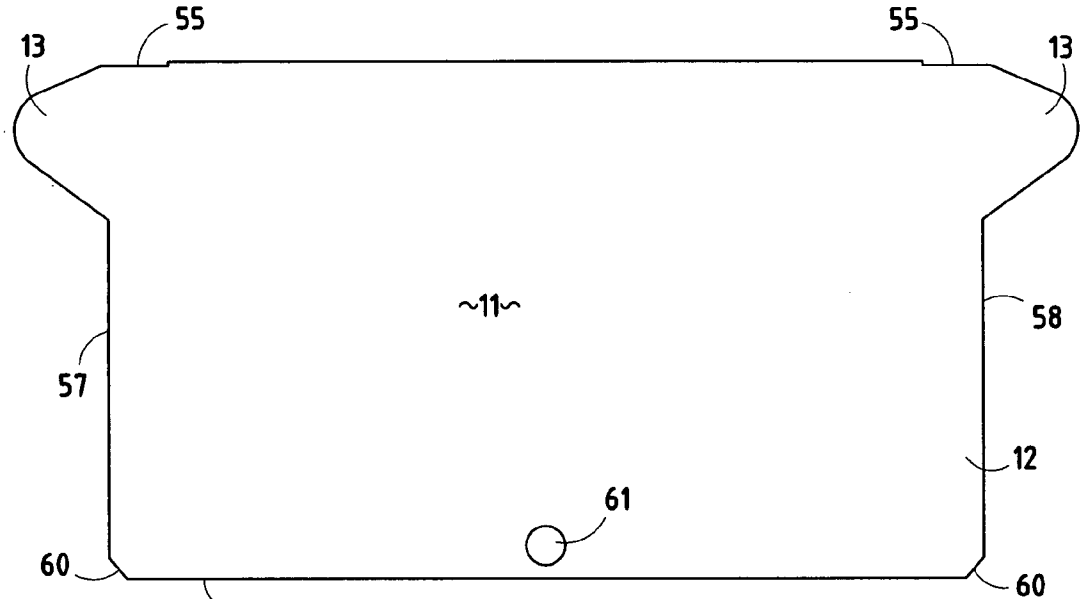
FIG. 5 is a front elevational view of the universal end cap.

For purposes of description herein, the terms "upper", "lower", "right", "left", "rear", "front", "vertical", "horizontal" and derivatives thereof shall relate to the invention as oriented in FIGS. 1 and 5. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a universal end cap embodying the present invention. In the illustrated example, universal end cap 1 is shown in combination with a rain gutter debris guard 2, which is in the form of an assembly having an inclined top cap 3 with a rearward portion 4 extending along an associated roof 5, a medial portion 6 extending over an interior portion 7 of an associated gutter 8, and a curved forward portion 9 extending adjacent to a front lip portion 10 of the gutter 8. Universal end cap 1 comprises a generally flat, rigid cover panel 11, which includes a substantially rectangularly-shaped lower portion 12 sized to extend over either one of the opposite ends of rain gutter debris guard 2 and gutter 8, and is severable to custom fit universal end cap 1 to a wide variety of different gutters. A pair of curved nose portions 13 project outwardly from the opposite side edges of cover panel 11 adjacent the upper edge thereof, and are configured to close off the curved forward portion 9 of top cap 3 at either one of the opposite ends thereof. A mounting flange 14 extends along at least a portion of the upper edge of the cover panel 11, and extends laterally inwardly for attachment to top cap 3 at either end of the gutter 8, such that universal end cap 1 encloses one of the opposite ends of rain gutter debris guard 2 to prevent debris from entering between the adjacent ends of the gutter 8 and the rain gutter debris guard 2.

Figure 2:
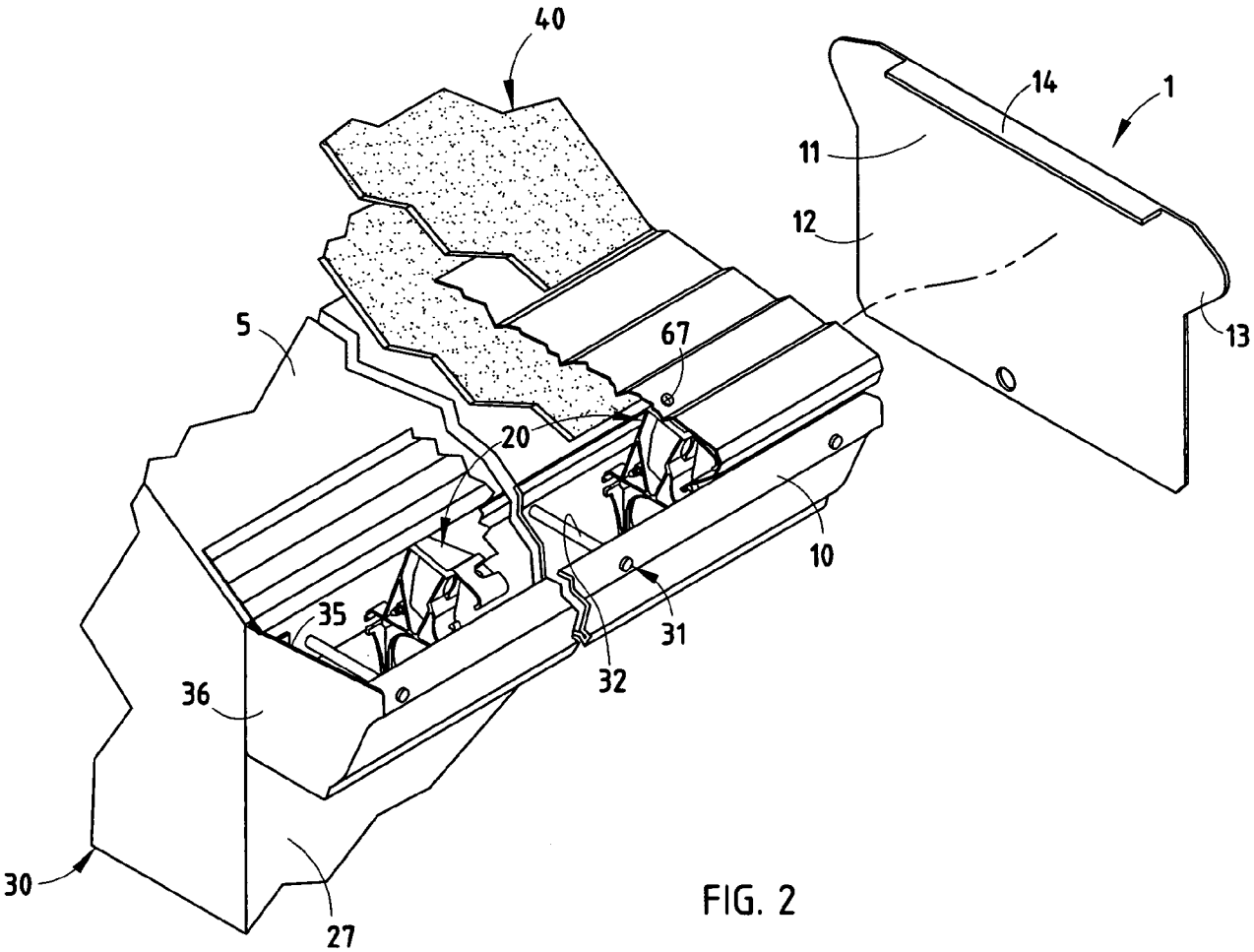
FIG. 2 is a perspective view of the universal end cap, shown exploded away from an assembled rain gutter and rain gutter debris guard.

With reference to FIGS. 1 and 2, universal end cap 1 is shown in conjunction with a unique gutter guard, which is disclosed in detail in related patent application Ser. No. 10/458,562, filed Jun. 10, 2003, entitled RAIN GUTTER GUARD AND METHOD, which is hereby incorporated herein by reference. The illustrated rain gutter guard 2 includes a plurality of mounting brackets 20, each of which has a rear portion 21 abutting the rear wall 22 of gutter 8, an upper portion 23 supporting top cap 3, and a forward portion 24 having a hook-shaped nose 25. The nose 25 of each mounting bracket 20 is configured to be inserted under an end flange portion 26 of gutter 8, and rotated rearwardly and laterally along a generally vertical arc about nose 25 toward the rear wall 22 of gutter 8 into a skewed orientation within the gutter interior 7. Each mounting bracket 20 is then pivoted laterally along a generally horizontal plane about nose 25 into a perpendicular orientation within gutter interior 7 to retain nose 25 in the front lip 10 of gutter 8, and facilitate attachment of the rear portion 21 of mounting bracket 20 to the rear wall 22 of gutter 8 and the associated roof fascia 27.

Gutter 8 is attached to building 30 in a conventional fashion, which as best illustrated in FIG. 2, includes a plurality of hangers 31, which are in the form of elongate nails that are driven through both the front lip 10 and rear wall 22 of gutter 8 and into the roof fascia 27. The nail-shaped hangers 31 are received through cylindrically-shaped collars or stretchers 32 to retain the trough shape of gutter interior 7. Hangers 31 are spaced apart along the length of gutter 8 in a manner to support the weight of the same, as well as the associated rainwater.

The illustrated gutter 8 (FIGS. 1 and 2) is formed from flat or coiled sheet metal into an open trough configuration, such that the open opposite ends of gutter 8 are closed by a pair of associated end plugs 35. In the illustrated example, end plugs 35 include end panels 36 with an inwardly directed, U-shaped flange 37 that is shaped for close reception within the interior 7 of gutter 8. End plugs 35 are retained in the opposite ends of gutter 8 by any suitable fastening means, such as screws, rivets, adhesives, soldering, or the like.

Figure 3:
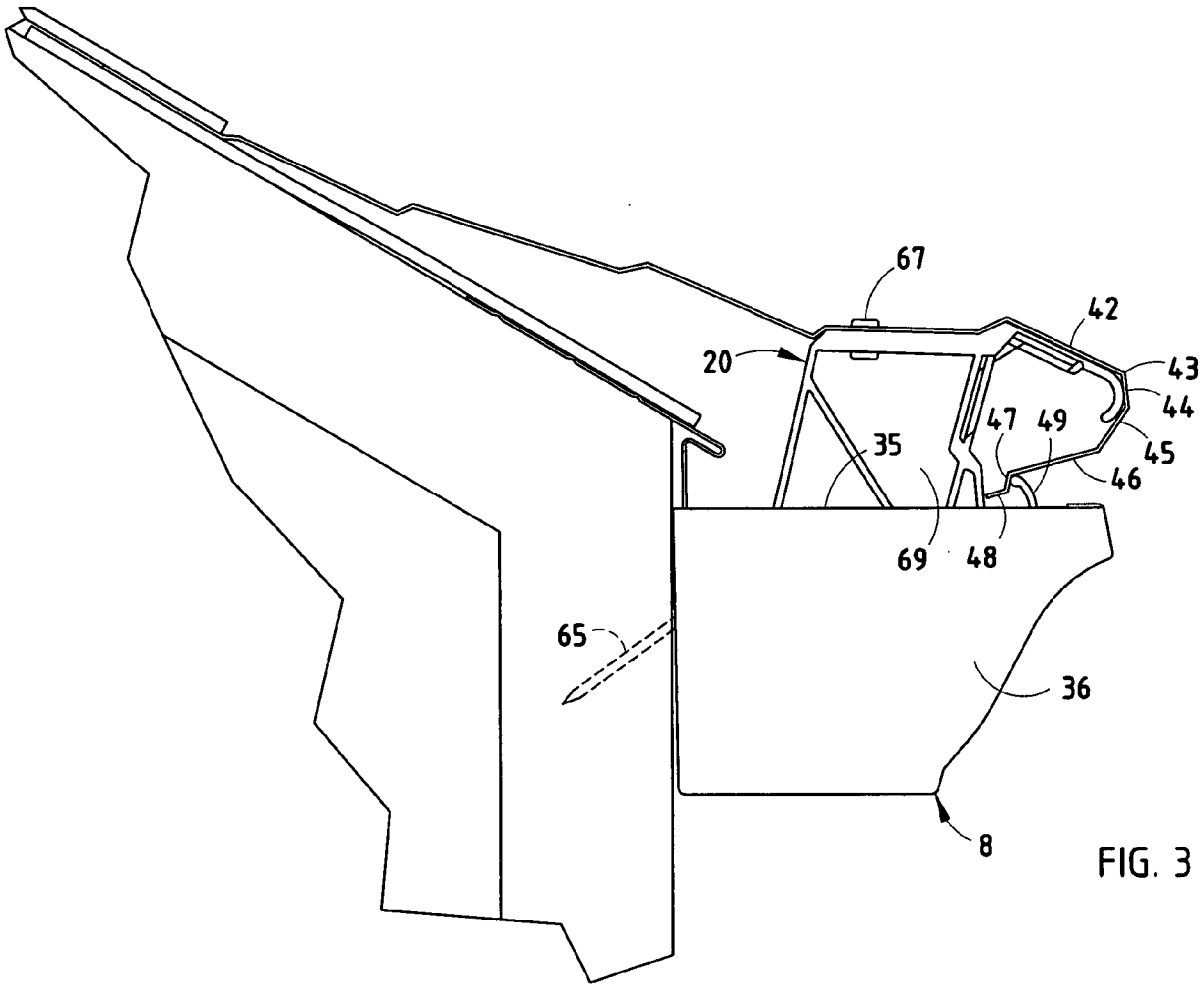
FIG. 3 is an end elevational view of the rain gutter and rain gutter debris guard.
Figure 7:
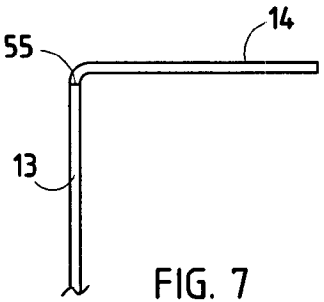
FIG. 7 is a fragmentary, enlarged, side elevational view of a top portion of the universal end cap.
Figure 6:
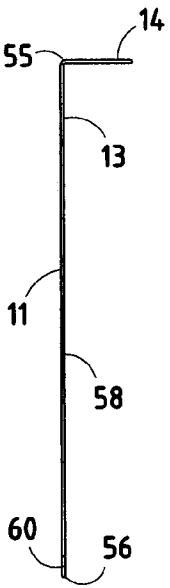
FIG. 6 is a side elevational view of the universal end cap.
Figure 4:
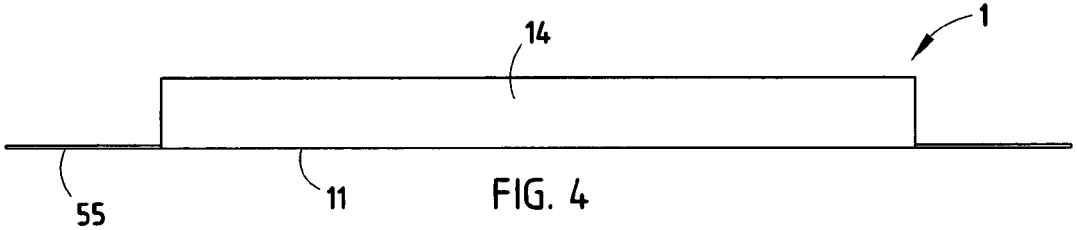
FIG. 4 is a top plan view of one of the universal end caps.

With reference to FIGS. 1–3, the illustrated top cap 3 is preferably formed form a relatively thin, substantially rigid sheet of metal, plastic, or the like, and is inclined downwardly at a predetermined angle. The rearward portion 4 of top cap 3 has a generally flat planar shape that is adapted to be inserted between the first and second courses of shingles 40 on building roof 5 to retain the same in place without nails or other fasteners. Top cap 3 has a forward portion 41, which is inwardly turned with a generally C-shaped configuration, and is positioned forwardly of the front lip 10 of gutter 8 to sweep water into the interior 7 of gutter 8, while deflecting debris onto the ground. More specifically, the forward portion 41 of top cap 3 includes angled flanges 42–44 which generally mate with the curved front portion 45 on mounting bracket 20, as well as flanges 46–48, which intersect to define a ledge into which the free edge of cap retainer 49 is received to connect the forward portion of top cap 3 with mounting bracket 20.

With reference to FIGS. 4–7, the generally flat, rigid cover panel 11 of universal end cap 1 includes an upper edge 55, a lower edge 56 and opposite side edges 57 and 58. The substantially rectangular lower portion 12 of cover panel 11 is sized to extend over either one of the opposite ends of the rain gutter debris guard and the gutter, and is severable to custom fit universal end cap 1 to a wide variety of different gutters. The curved nose portions 13 of the illustrated universal end cap 1 project outwardly from the opposite side edges 57 and 58 of cover panel 11 adjacent the upper edge 55 thereof, and are configured to close off the curved forward portion of top cap 3 at either one of the opposite ends thereof. Mounting flange 14 extends along at least a portion of the upper edge 55 of cover panel 11, and extends laterally inwardly in a generally perpendicular relationship with cover panel 11 for attachment to top cap 3 at either end of the gutter 8. A retainer 59 (FIG. 10) fastens mounting flange 14 to top cap 3 at either one of the opposite ends thereof, such that universal end cap 1 encloses one of the opposite ends of the rain gutter debris guard 2 to prevent debris from entering between the adjacent ends of the gutter 8 and rain gutter debris guard 2.

In the illustrated example, each universal end cap 1 (FIGS. 4–7) has a one-piece construction, wherein mounting flange 14 is formed integrally with cover panel 11. Preferably, universal end cap 1 is constructed from sheet metal, and may be blanked from a sheet or roll to the appropriate shape, with mounting flange 14 being bent after blanking. The use of sheet metal also facilitates custom fitting universal end cap 1 to a specific rain gutter debris guard, as described in greater detail below. The upper edge 55 of cover panel 11 is generally straight, and disposed substantially parallel with lower edge 56. Furthermore, the opposite side edges 57 and 58 of cover panel 11 at the lower portion 12 thereof are generally parallel, and oriented substantially perpendicular to the upper edge 55 and lower edge 56 of cover panel 11. The opposite lower corners 60 of cover panel 11 extend diagonally between side edges 57 and 58 and lower edge 56. The illustrated universal end cap 1 includes an aperture 61 through the lower portion 12, adjacent lower edge 56 to facilitate manufacturing.

In one working example of universal end cap 1, cover panel 11 has a width of approximately 11 to 12 inches, as measured between side edges 57 and 58, a height of approximately 6 to 7 inches, as measured between upper edge 55 and lower edge 56, and a span between the ends of nose portions 13 of approximately 13 to 14 inches, as measured between the outermost points thereon. In the exemplary working embodiment of universal end cap 1, nose portions 13 have a radius of approximately 0.5 inches, and protrude outwardly from the opposite side edges 57 and 58 by around 1 to 1½inches, whereas the height of the rectangular lower portion 12 is around 4 to 4½inches, with the width of mounting flange 14 being around ¾ to 1 inch.

Figure 10:
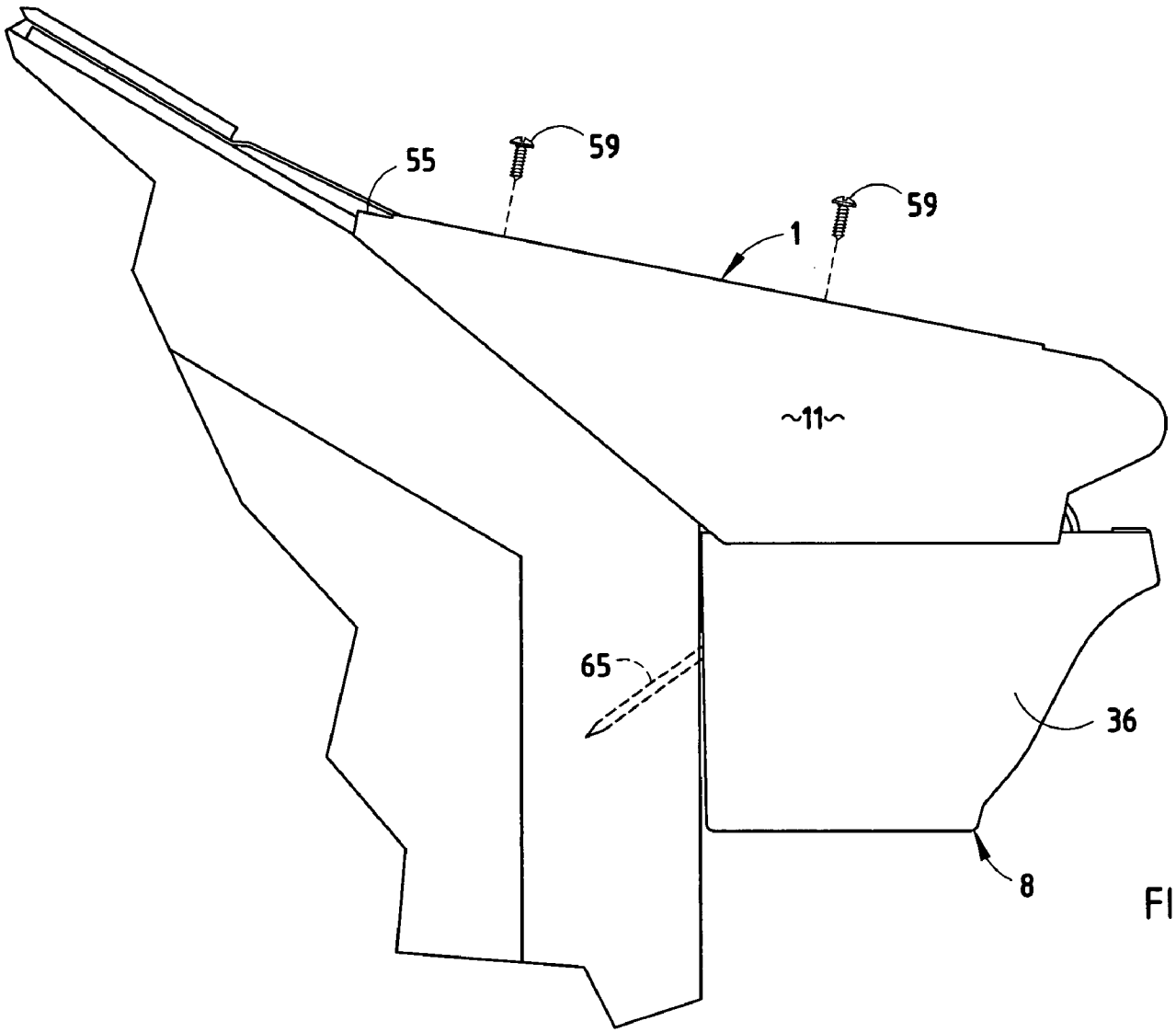
FIG. 10 is an end elevational view of the assembly illustrated in FIGS. 8 and 9, shown after trim, and with the universal end cap fully installed.
Figure 12:
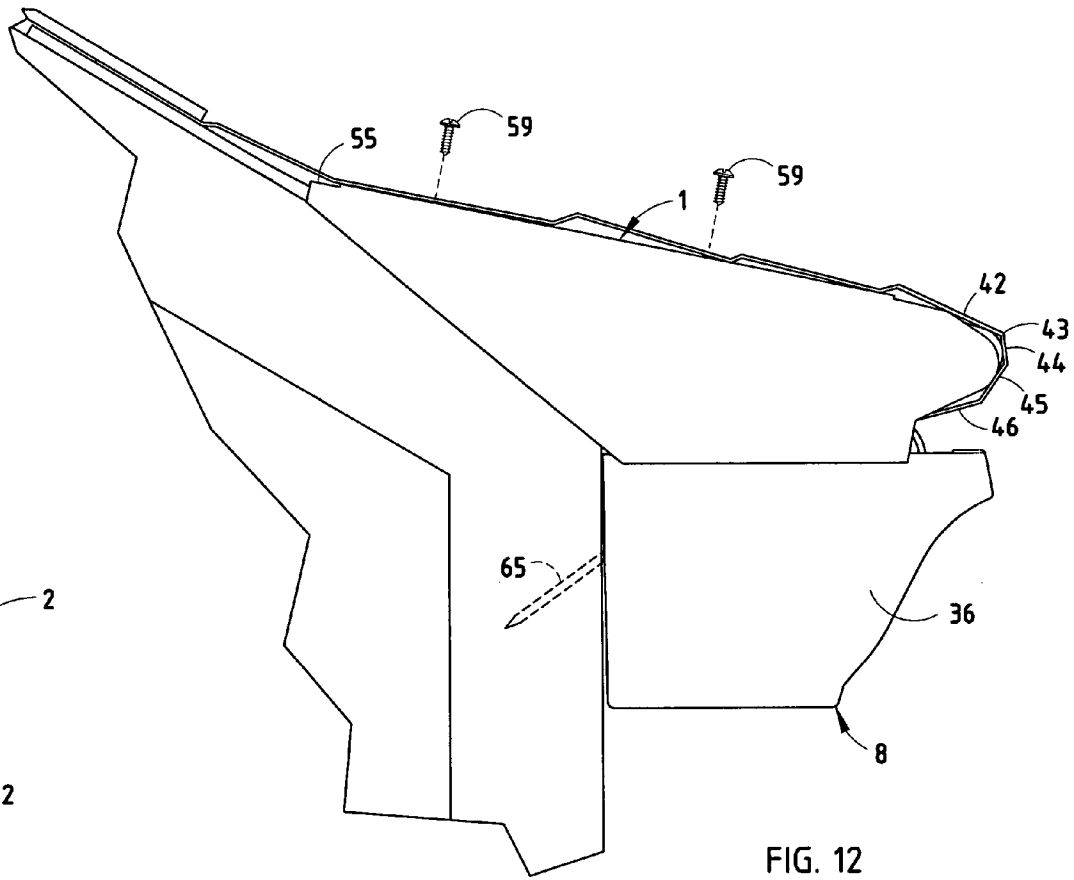
FIG. 12 is an end elevational view of another embodiment of the present invention, wherein the universal end cap is mounted along the lower surface of the top cap.
Figure 11:
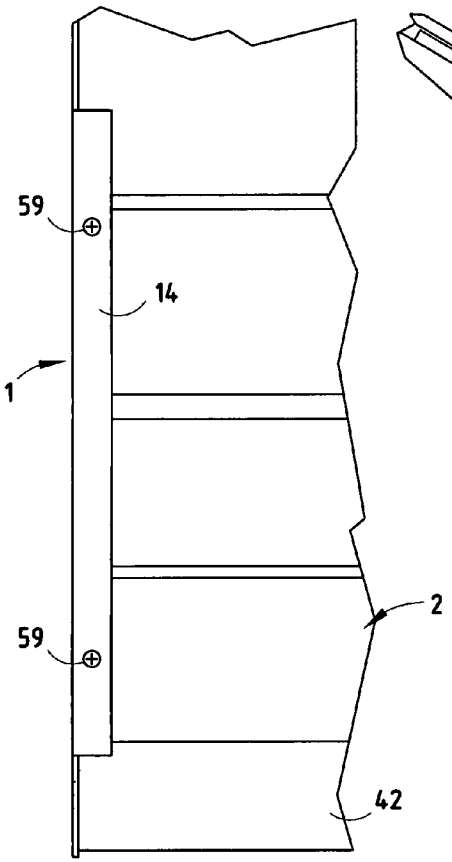
FIG. 11 is a fragmentary, top plan view of the assembly illustrated in FIGS. 8–10, with the universal end cap fully installed.

With reference to FIG. 10, the illustrated retainer 59 is in the form of a self-piercing screw constructed from aluminum, or other materials that are resistant to rusting. Screws 59 are relatively short, and are driven into and through the mounting flange 14 of universal end cap 1 using a conventional power driver or the like. In the illustrated example, each universal end cap is attached to top cap 3 by two self-piercing screws 59 that extend through the associated mounting flange 14 at spaced apart locations thereon, and into top cap 3. Preferably, a mounting bracket 20 is positioned at each end of gutter 8, such that self-piercing screws 59 are driven into the underlying mounting bracket 20 and anchored therein. It is to be understood that while the illustrated retainers 59 are in the from of self-piercing screws, other types of fastening systems can also be used, such as rivets, adhesives, soldering, or the like.

In operation, rain gutter debris guard 2 is installed on an associated gutter 8 in the manner set forth in detail in the above-noted pending patent application Ser. No. 10/458,562, filed Jun. 10, 2003, entitled RAIN GUTTER GUARD AND METHOD, wherein mounting brackets 20 are rotated into place within the interior 7 of gutter 8, and securely retained in place by fasteners 65 which extend through the rear wall 22 of gutter 8 and into roof fascia 27. Top cap 3 is attached to the installed mounting brackets 20 in the following fashion. The front edge 45 of top cap 3 is positioned along the forward portion 24 of mounting brackets 20, such that the ledge formed by flanges 46–48 is positioned behind the free edge of top cap retainer 49, as shown in FIG. 3. Top cap 3 is then rotated rearwardly, with the rearward portion 4 being inserted beneath the second course of roof shingles 40, and then shifting top cap 3 toward the roof 5, so that the cap ledge is captured by cap retainer 49, and the forward portion 41 of top cap 3 is received over the front of mounting bracket 20. Fasteners 67 (FIGS. 1 and 2) are then driven vertically through top cap 3 into the rear portion of mounting brackets 20 to positively attach top cap 3 to mounting brackets 20. Because the apertures through which fasteners 67 are inserted are positioned directly above the interior 7 of gutter 8, the fasteners 67 need not be watertight or otherwise sealed.

As best illustrated in FIG. 3, after top cap 3 has been installed, the opposite ends thereof, above gutter 8, define open spaces 69 that are vulnerable to the inflow of debris or the like, which will adversely impact the operation of rain gutter debris guard assembly 2. Universal end cap 1 is specifically designed to close off these openings 69, so as to prevent debris from entering into the interior 7 of gutter 8.

The illustrated universal end cap 1 is preferably installed over both of the open ends of rain gutter debris guard 2 in the following fashion. Since universal end cap 1 can be used to enclose either the left or right hand end of rain gutter debris guard assembly 2, reference shall be had herein to the installation of only one of the universal end caps 1, it being understood that the opposite end of the rain gutter debris guard 2 can be enclosed in a similar fashion, using a second universal end cap 1.

Figure 8:
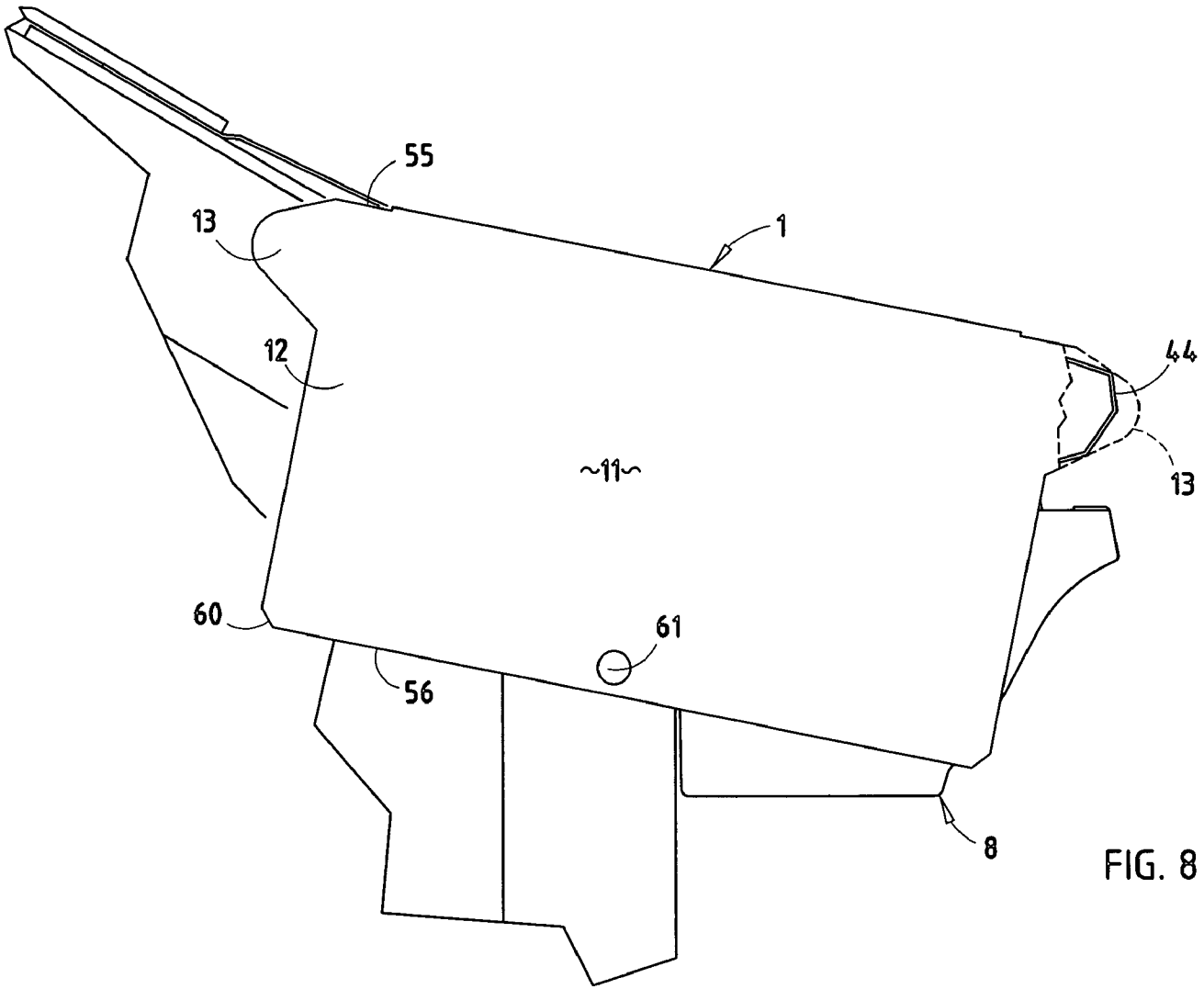
FIG. 8 is an end elevational view of the rain gutter and rain gutter debris guard, with a universal end cap positioned over the adjacent ends thereof prior to trim measurement.
Figure 9:
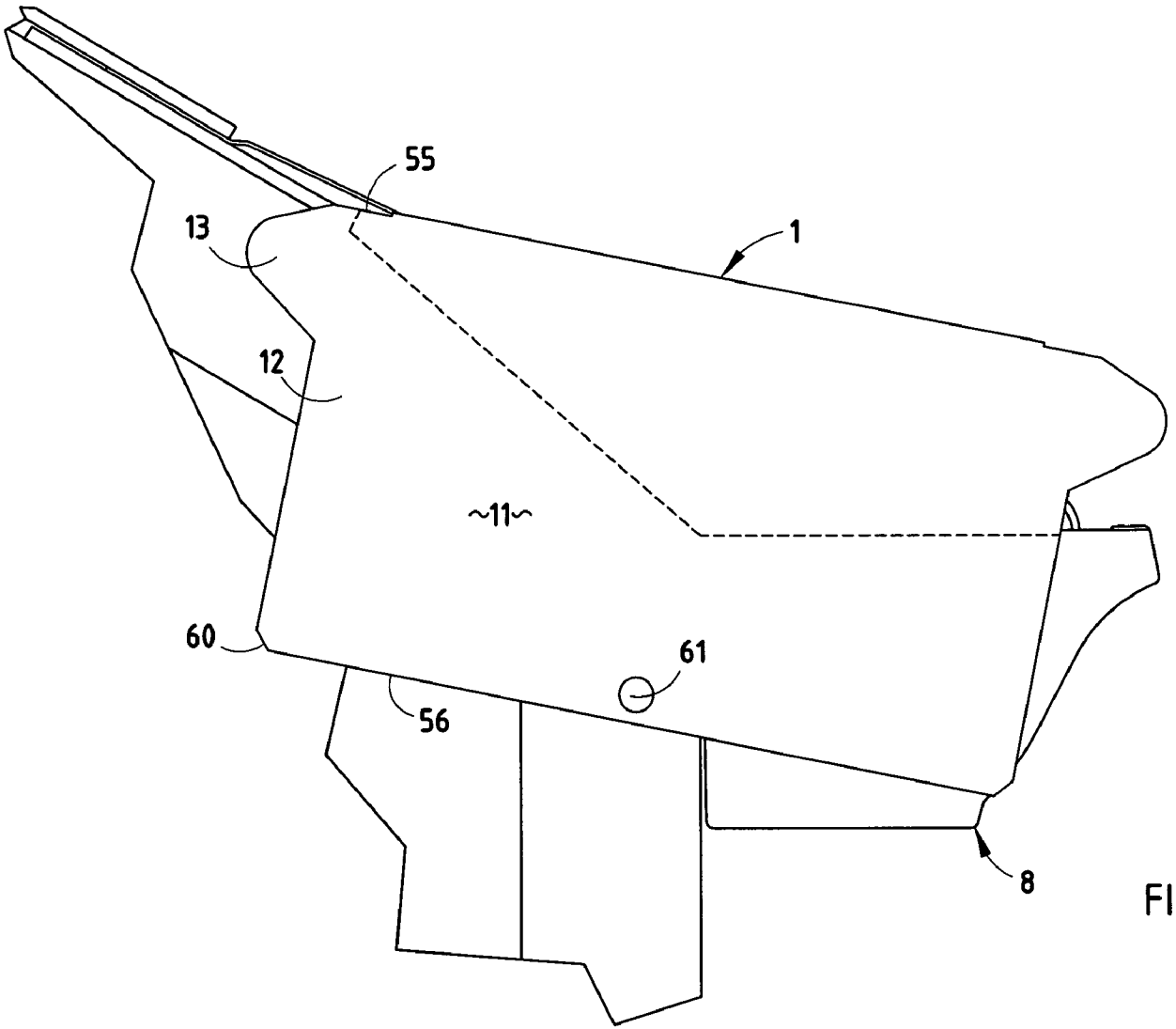
FIG. 9 is an end elevational view of the assembly illustrated in FIG. 8, shown after trim measurement.

As best illustrated in FIG. 8, the installer first positions universal end cap 1 at on of the open opposite ends of the rain gutter debris guard 2 to close off the associated opening 69. The mounting flange 14 on top cap 3 is disposed upwardly, along the upper surface of top cap 3, and the outwardly protruding nose portion 13 on the forward half of universal end cap 1 is positioned to enclose the curved forward edge of top cap 3, as shown in FIG. 8. The installer then notes the location of the upper edge of gutter 8 and the angle of roof 5, and marks a cut line 70 along the outer surface of universal end cap 1 in the fashion illustrated in FIG. 9, using a pencil, marker, scribe, or the like. Universal end cap 1 is then cut along cut line 70, preferably using shears, snips, scissors, or other similar hand tools. The custom cut universal end cap 1 is then repositioned over the associated end of rain gutter debris guard 2 in the fashion illustrated in FIG. 10. Fasteners 59 are then driven vertically through the mounting bracket 20 of universal end cap 1 into top cap 3 along a medial portion thereof to positively attach universal end cap 1 to rain gutter debris guard assembly 2. As noted above, preferably, self-piercing and/or tapping fasteners 59 are for pre-drilling holes in mounting flange 14. Because the apertures formed by fasteners 59 are located directly above the interior 7 of gutter 8, the fasteners 59 need not be watertight or otherwise sealed.

FIG. 13 illustrates an alternate embodiment of the present invention, wherein the mounting flange 14 of universal end cap 1 is positioned below the lower surface of top cap 3. In this arrangement, self-piercing screws 59 are first driven through the end of top cap 3, and then into the mounting flange 14 of universal end cap 1. The embodiment shown in FIG. 13 is particularly advantageous when a mounting bracket 20 in located at the end of gutter 8, such that the mounting flange 14 of universal end cap 1 is captured between the lower surface of top cap 3 and the upper surface of mounting bracket 20, with retainers 59 being driven into and anchored in mounting bracket 20.

As will be appreciated by those skilled in the art, universal end cap 1 may be used in conjunction with a wide variety of different types of gutter guards, including perforated styles such as screens, expanded metal panels, etc., as well as imperforate styles, such as the illustrated nose forward design.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. In a rain gutter debris guard having an inclined top cap with a rearward portion extending along an associated roof, a medial portion extending over an interior portion of an associated gutter, and a curved forward portion extending adjacent to a front lip portion of the gutter, the improvement of a universal end cap comprising:

a generally flat, rigid cover panel having an upper edge, a lower edge, and opposite side edges, and including:

a substantially rectangular lower portion sized to extend over either one of the opposite ends of said rain gutter debris guard and the gutter, and being severable to custom fit said end cap to a wide variety of different gutters; and a pair of curved nose portions projecting outwardly from the opposite side edges of said cover panel adjacent said upper edge thereof, and configured to close off the curved forward portion of said top cap at either one of the opposite ends thereof;

a mounting flange extending along at least a portion of the upper edge of said cover panel, and extending laterally inwardly in a generally perpendicular relationship with said cover panel for attachment to said top cap at either end of the gutter; and a retainer means for fastening said mounting flange to said top cap at either one of the opposite ends thereof, such that said end cap encloses one of the opposite ends of said rain gutter debris guard to prevent debris from entering between the adjacent ends of the gutter and said rain gutter debris guard.

2. A rain gutter debris guard as set forth in claim 1, wherein:

said end cap has a one-piece construction, wherein said mounting flange is formed integrally with said cover panel.

3. A rain gutter debris guard as set forth in claim 2, wherein:

said end cap is constructed from sheet metal to facilitate custom fitting said end cap to said rain gutter debris guard.

4. A rain gutter debris guard as set forth in claim 3, wherein:

said mounting flange includes at least one vertically extending fastener formed aperture therethrough.

5. A rain gutter debris guard as set forth in claim 4, wherein:

said retainer means includes at least one screw extending through said fastener formed aperture and into said top cap.

6. A rain gutter debris guard as set forth in claim 5, wherein:

said upper edge of said cover panel is generally straight, and disposed substantially parallel with the lower edge of said cover panel.

7. A rain gutter debris guard as set forth in claim 6, wherein:

said opposite side edges of said cover panel at said lower portion thereof are generally parallel, and oriented substantially perpendicular to said upper edge and said lower edge of said cover panel.

8. A rain gutter debris guard as set forth in claim 7, wherein:

said retainer means attaches said end cap to said medial portion of said top cap.

9. A rain gutter debris guard as set forth in claim 8, wherein:

said cover panel includes opposite lower corners which extend diagonally between said side edges and said lower edge.

10. A rain gutter debris guard as set forth in claim 9, wherein:

said top cap is generally imperforate to direct rainwater around said curved forward portion thereof into the interior of the gutter.

11. A rain gutter debris guard as set forth in claim 10, wherein:

said curved forward portion of said top cap is shaped to extend beyond the front lip portion of the gutter to sweep rainwater into the interior portion of the gutter and deflect debris therefrom.

12. A rain gutter debris guard as set forth in claim 11, wherein:

said rearward portion of said top cap is shaped for insertion under adjacent roof shingles.

13. A rain gutter debris guard as set forth in claim 12, including:

at least one mounting bracket shaped for reception within the interior of the gutter, and supporting said top cap.

14. A rain gutter debris guard as set forth in claim 13, wherein:

said top cap is supported solely on said mounting bracket, such that said rain gutter debris guard does not penetrate or damage the roof shingles.

15. A rain gutter debris guard as set forth in claim 1, wherein:

said end cap is constructed from sheet metal to facilitate custom fitting said end cap to said rain gutter debris guard.

16. A rain gutter debris guard as set forth in claim 1, wherein:

said mounting flange includes at least one vertically extending fastener formed aperture therethrough.

17. A rain gutter debris guard as set forth in claim 1, wherein:

said retainer means includes at least one screw extending through said mounting flange and into said top cap.

18. A rain gutter debris guard as set forth in claim 1, wherein:

said top cap is generally imperforate to direct rainwater around said curved forward portion thereof into the interior of the gutter.

19. A rain gutter debris guard as set forth in claim 1, wherein:

said upper edge of said cover panel is generally straight, and disposed substantially parallel with the lower edge of said cover panel.

20. A rain gutter debris guard as set forth in claim 1, wherein:

said opposite side edges of said cover panel at said lower portion thereof are generally parallel, and oriented substantially perpendicular to said upper end and said lower edge of said cover panel.

21. A rain gutter debris guard as set forth in claim 1, wherein:

said retainer means attaches said end cap to said medial portion of said top cap.

22. A rain gutter debris guard as set forth in claim 1, including:

at least one mounting bracket shaped for reception within the interior of the gutter, and supporting said top cap.

23. A rain gutter debris guard as set forth in claim 1, wherein:

said curved forward portion of said top cap is shaped to extend beyond the front lip portion of the gutter to sweep rainwater into the interior portion of the gutter and deflect debris therefrom.

24. A rain gutter debris guard as set forth in claim 1, wherein:

said rearward portion of said top cap is shaped for insertion under adjacent roof shingles; and said top cap is supported solely on said rain gutter debris guard, such that said rain gutter debris guard does not penetrate or damage the roof shingles.

25. A rain gutter debris guard, comprising:

an inclined top cap with a rearward portion extending along an associated roof, a medial portion extending over an interior portion of an associated gutter, and a curved forward portion extending adjacent to a front lip portion of the gutter;

a universal end cap, having:

a generally flat, rigid cover panel with an upper edge, a lower edge, and opposite side edges, and including a substantially rectangular lower portion sized to extend over either one of the opposite ends of said rain gutter debris guard and the gutter, and being severable to custom fit said end cap to a wide variety of different gutters, and a pair of curved nose portions projecting outwardly from the opposite side edges of said cover panel adjacent said upper edge thereof, and configured to close off the curved forward portion of said top cap at either one of the opposite ends thereof;

a mounting flange extending along at least a portion of the upper edge of said cover panel, and extending laterally inwardly in a generally perpendicular relationship with said cover panel for attachment to said top cap at either end of the gutter; and a retainer means for fastening said mounting flange to said top cap at either one of the opposite ends thereof, such that said end cap encloses one of the opposite ends of said rain gutter debris guard to prevent debris from entering between the adjacent ends of the gutter and said rain gutter debris guard.

26. A universal end cap for rain gutter debris guards of the type having an inclined top cap with a rearward portion extending along an associated roof, a medial portion extending over an interior portion of an associated gutter, and a curved forward portion extending adjacent to a front lip portion of the gutter; said universal end cap comprising:

a generally flat, rigid cover panel having an upper edge, a lower edge, and opposite side edges, and including:

a substantially rectangular lower portion sized to extend over either one of the opposite ends of the rain gutter debris guard and the gutter, and being severable to custom fit said end cap to a wide variety of different gutters; and a pair of curved nose portions projecting outwardly from the opposite side edges of said cover panel adjacent said upper edge thereof, and configured to close off the curved forward portion of the top cap at either one of the opposite ends thereof;

a mounting flange extending along at least a portion of the upper edge of said cover panel, and extending laterally inwardly in a generally perpendicular relationship with said cover panel for attachment to the top cap at either end of the gutter; and a retainer means for fastening said mounting flange to the top cap at either one of the opposite ends thereof, such that said end cap encloses one of the opposite ends of the rain gutter debris guard to prevent debris from entering between the adjacent ends of the gutter and the rain gutter debris guard.

27. A method for deflecting debris from rain gutters having a generally trough-shaped interior, and a front lip, comprising:

providing a top cap having a rearward portion thereof shaped to extend along an associated roof, a medial portion thereof shaped to extend over the interior of the gutter and a forward portion thereof shaped to extend adjacent the front lip of the gutter;

providing at least one mounting bracket, having a rearward portion thereof shaped to abut a rear wall of the gutter, and an upper portion thereof shaped to support the top cap to deflect debris from the interior of the gutter;

attaching of the rearward portion of the mounting bracket to the rear wall of the gutter and adjacent roof fascia;

attaching the top cap to the upper portion of the mounting bracket, such that the top cap overlies the interior of the gutter to deflect debris therefrom;

providing at least one universal end cap having a generally flat, rigid cover panel with an upper edge, a lower edge, and opposite side edges, as well as a substantially rectangular lower portion sized to extend over either one of the opposite ends of the gutter, and being severable to custom fit the end cap to a wide variety of different gutters, a pair of curved nose portions projecting outwardly from the opposite side edges of the cover panel adjacent the upper edge thereof to close off the curved forward portion of the top cap at either one of the opposite ends thereof, and a mounting flange extending along at least a portion of the upper edge of the cover panel, and extending laterally inwardly in a generally perpendicular relationship with the cover panel for attachment to the top cap at either end of the gutter;

fastening the mounting flange of the universal end cap to the top cap at either one of the opposite ends thereof, such that the universal end cap encloses the space between the adjacent ends of the gutter and top cap to prevent debris from entering therebetween.

28. A rain gutter debris guard as set forth in claim 1, wherein:

said retainer means includes at least one rivet extending into said top cap.

* * * * *